US005230516A

United States Patent [19]

Semmens

[11] Patent Number: 5,230,516

[45] Date of Patent: Jul. 27, 1993

[54] WEB WARS

[76] Inventor: Thomas R. Semmens, 3250 Duneville, Las Vegas, Nev. 89102

[21] Appl. No.: 873,014

[22] Filed: Apr. 24, 1992

[51] Int. Cl.[5] ..... A63F 3/00

[52] U.S. Cl. ..... 273/271; 273/264; 273/287

[58] Field of Search ..... 273/239, 240, 258, 260, 273/261, 263, 264, 271, 275, 287

[56] References Cited

U.S. PATENT DOCUMENTS

| | | | |
|---|---|---|---|
| 957,800 | 5/1910 | Richardson | 273/264 |
| 2,722,424 | 11/1955 | Hum | 273/264 |
| 4,579,347 | 4/1986 | Reman | 273/264 |
| 4,852,887 | 8/1989 | Li | 273/264 |
| 4,971,331 | 11/1990 | Fabian et al. | 273/271 |

*Primary Examiner*—V. Millin
*Assistant Examiner*—William M. Pierce
*Attorney, Agent, or Firm*—John P. Halvonik

[57] ABSTRACT

The invention is a two-player board game in which the object is to occupy four adjacent spaces in a row. The gameboard is a configuration of four concentric circles divided by four lines to create 32 game spaces. The game is won by getting four adjacent spaces occupied in a row. Adjacent spaces being those in the same concentric circle; or by getting four spaces radiating out from the center of the circle in the same quadrant; or by having four spaces spaces in a spiral configuration (otherwise known as a diagonal configuration) from center circle to outermost circle.

1 Claim, 1 Drawing Sheet

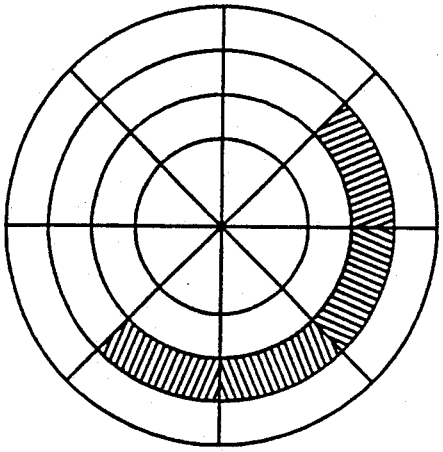
Fig. A
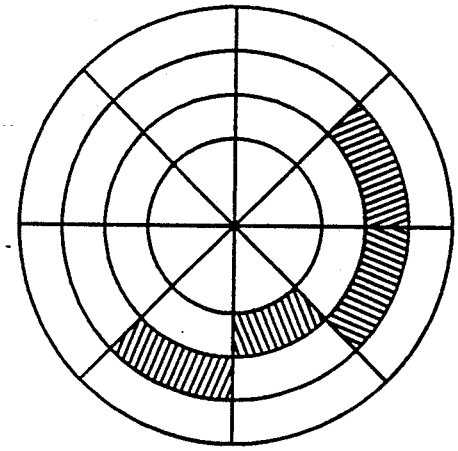
Fig. B
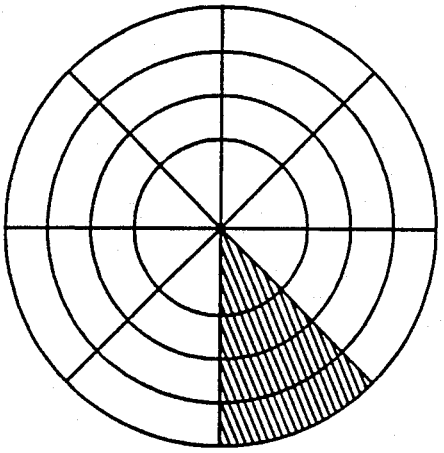
Fig. C
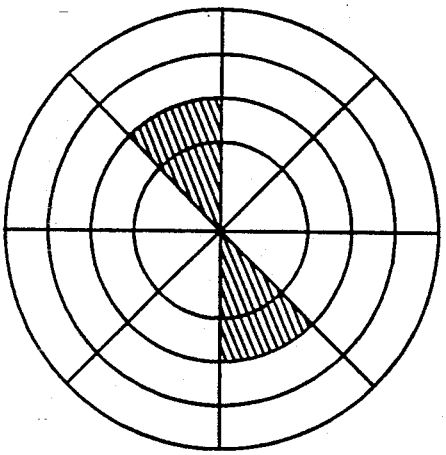
Fig. D
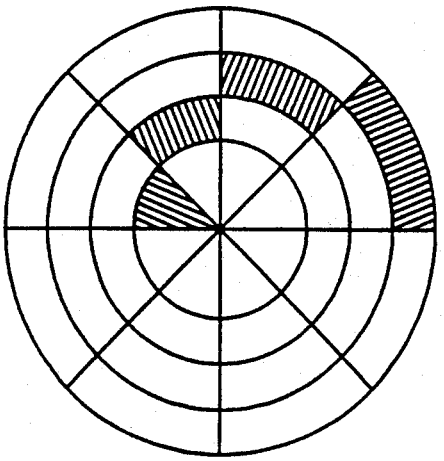
Fig. E
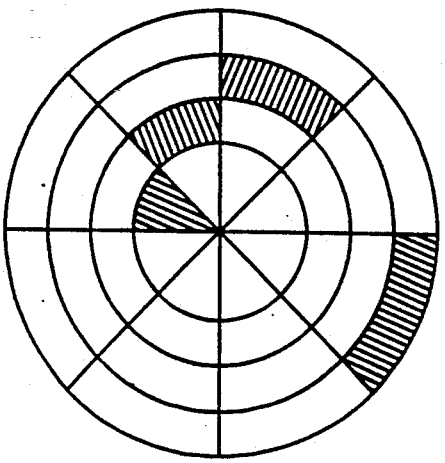
Fig. F

WEB WARS

BACKGROUND

1. Field of the Invention

The invention relates to a competitive game, played between two players that involves occupying spaces on a board with tokens played on the board one at at time. The object of the game is to occupy four adjacent spaces in any one of three directions, up or down, left or right and along an angle. The spaces on the game board are rectangular or square shaped and are arranged in a spiral configuration.

2. Description of the Prior Art

Board games do exist in the prior art that involve the occupation of spaces on a game board such as Go and Tic Tac Toe. Most such games, including that of the subject application, involve two players taking turns laying down tokens on the board and eventually, in most such games, one of the players wins the game by occupying spaces in a certain configuration agreed upon before hand as the winning configuration. In the game of tic tac doe, for example, two players alternately occupy spaces in a 9 space game board until one completes three squares in a row, up and down, or left and right, or along a diagonal. The game that is the subject of this application is similar to tic tac toe in that adjacent spaces must be occupied to establish a winning configuration. The game board here comprises concentric rings further divided into individual spaces.

SUMMARY OF THE INVENTION

A two player, competitive board game involving occupying spaces on a game board comprising concentric rings divided into spaces. The object is to occupy four adjacent spaces in a row be they: adjacent along a circular row or ring, up or down across four rows or along a diagonal along four rows. The gameboard is a configuration of four concentric circles divided across the face of the circles by four intersecting lines. In the preferred embodiment the game board comprises thirty two spaces. arranged on a game board comprising four circular rows of spaces with 8 spaces per row. The object of the game is to be the first player to complete a configuration of four adjacent spaces in a row.

It is an object of the game to provide an entertaining game for two players taking turns occupying spaces in a game board comprising concentric rings divided into spaces.

Another object of the game is to provide a tic tac toe type game involving a game board comprising concentric rings divided into spaces with the object being to occupy four spaces in a row be they across, up or down and along a diagonal.

Another objective of the game is to provide a stimulating board game that can be played by people of virtually all ages.

Other objectives of the game will become apparent to those skilled in the art.

DESCRIPTION OF THE DRAWINGS

FIG. A shows four adjacent spaces within the same circle (a winning combination).

FIG. B shows four adjacent spaces which are not in the same circle (not a wining combination).

FIG. C shows four spaces radiating from the center of the circles and in the same quadrant (a winning combination).

FIG. D shows four spaces originating from the center of the circles but not within the same quadrant (not a winning combination).

FIG. E shows four spaces in a spiral configuration which are adjacent by quadrant (a winning combination).

FIG. F shows four spaces in a spiral configuration which are not adjacent (not a winning combination).

DESCRIPTION OF THE PREFERRED EMBODIMENT

The game as shown and described is designed for use by people of all ages. The gameboard is a configuration of four concentric circles divided across the face of the circles by four intersecting lines to create a game board that comprises thirty two spaces arranged in four layers of these spaces. There are four rows of spaces as shown with 8 spaces per row.

The game is played by designating one player to go first and the two players take turns alternately laying tokens on the spaces of the game board to symbolically occupy these spaces. The object of the game is to be the first player to complete a configuration of four spaces in a row. The possible ways to win the game are: by getting four adjacent spaces in the same concentric circle; by getting four spaces radiating out from the center of the circle in the same quadrant; and by having four spaces along a diagonal along each of the four rows from center circle to outermost circle.

FIG A. illustrates the first way to win, by occupying four adjacent spaces in the same rows also referred to as being lateral to one another. FIG. C shows four spaces occupied in up and down relation another winning configuration and FIG. E illustrates the diagonal configuration which involves spaces occupied in diagonal relation to one another. FIG. B is not a winning configuration as the spaces are not all four in the same row. FIG. D illustrates the up down configuration which is not a winning configuration if the spaces are occupied across the center of the board. FIG. F illustrates that in the diagonal configuration the spaces must be occupied adjacent to one another in order to be a winning configuration.

I claim:

1. A method of playing an entertaining game for a plurality of players comprising the steps of:

a) providing a game board of concentric circles further divided into spaces about each circle, said board having a center circle divided into a plurality of spaces adjacent one another and further providing a plurality of sets of tokens;

b) designating a player to go first and said first player selecting a set of corresponding tokens;

c) said first player placing a token on a space not occupied by another token;

d) designating a player to go next and said next player selecting a set of corresponding tokens;

e) said next player placing a token on a space not occupied by another token;

f) repeating steps d and e until each player has placed a token;

g) repeating step c and then repeating step e for each player until four adjacent spaces are occupied by tokens of a given set, or until all the spaces are occupied, wherein adjacent spaces are alongside one another in the same row, adjacent rows or diagonally across, and;

h) declaring a winner to be the player whose tokens correspond to said occupied adjacent spaces.

* * * * *